US005341600A

United States Patent [19]

Heppner

[11] Patent Number: 5,341,600

[45] Date of Patent: Aug. 30, 1994

[54] SLIDING DOOR SILL CONSTRUCTION

[75] Inventor: Thomas J. Heppner, Warroad, Minn.

[73] Assignee: Marvin Lumber and Cedar Co., Warroad, Minn.

[21] Appl. No.: 15,068

[22] Filed: Feb. 8, 1993

Related U.S. Application Data

[63] Continuation of Ser. No. 642,642, Jan. 17, 1991, abandoned.

[51] Int. Cl.[5] ..... G06B 1/70

[52] U.S. Cl. ..... 49/471; 49/408; 52/207

[58] Field of Search ..... 49/408, 467, 469, 471, 49/404, 496.1, 489.1, 475.1; 52/207, 209

[56] References Cited

U.S. PATENT DOCUMENTS

| | | | |
|---|---|---|---|
| 2,782,887 | 2/1957 | Zimmermann | 49/489.1 |
| 3,091,008 | 5/1963 | Riegelman | 49/409 |
| 3,199,156 | 8/1965 | Riegelman | 49/408 |
| 3,314,201 | 4/1967 | Riegelman | 49/408 X |
| 3,410,027 | 11/1968 | Bates | 49/471 |
| 3,859,754 | 1/1975 | Budich et al. | 49/471 X |
| 4,157,634 | 6/1979 | Coulston | 49/489.1 |
| 4,229,905 | 10/1980 | Rush | 52/209 X |
| 4,319,430 | 3/1982 | Menard | 52/207 X |
| 4,674,246 | 6/1987 | Giguere | 52/207 |
| 4,815,246 | 3/1989 | Haas | 52/207 |
| 4,924,628 | 5/1990 | Ruby et al. | 49/408 X |
| 4,967,507 | 11/1990 | Visnic et al. | 52/209 X |

FOREIGN PATENT DOCUMENTS

| | | | |
|---|---|---|---|
| 126715 | 8/1982 | Japan | 49/471 |
| 1235025 | 6/1971 | United Kingdom | 49/496.1 |
| 2155088 | 9/1986 | United Kingdom | 52/209 |

*Primary Examiner*—Peter M. Cuomo
*Assistant Examiner*—Jerry Redman
*Attorney, Agent, or Firm*—Nawrocki, Rooney & Sivertson

[57] ABSTRACT

A door sill in a frame mounting a fixed door panel and a sliding door panel movable along a longitudinally-extending track wherein the sliding door panel is disposed inwardly of the fixed door panel for movement thereof. The door sill comprising a sill floor external to the portion of an opening defined by the frame which is unobstructed by the fixed door panel. The door sill further comprising a platform elevated above the sill floor intermediate the sliding door panel track and the fixed door panel and abutting the sliding door panel track to define a drainage channel. The door sill further comprises a weatherstrip, having a pair of legs, extending along an outer surface of the track along which the sliding door panel moves whereby the first leg being generally parallel to and engaged against the track along which the sliding door is movable and a second generally planar leg being hinged to a top edge of the first leg and the second leg is biased upwardly and away from the first leg and into engagement with a bottom edge of the sliding door panel.

4 Claims, 1 Drawing Sheet

SLIDING DOOR SILL CONSTRUCTION

This is a continuation, of application Ser. No. 07/642,642, filed Jan. 17, 1991, now abandoned.

TECHNICAL FIELD

The present invention deals broadly with the field of entry closures for buildings. More narrowly, however, it is related to sliding door closures, for example, for residential dwellings. The specific focus for the invention is a sill construction for sliding doors.

BACKGROUND OF THE INVENTION

Various types of access doors for buildings are known in the prior art. Certainly, hinged doors are the most common variety, and such closure doors have been used in buildings since time immemorial.

Another type of closure door existent in the prior art is a door having a fixed panel and a sliding panel mounted for reciprocal lateral movement relative to the fixed panel. Such sliding doors are known as French doors. This type of sliding door is particularly utilizable in residential dwellings, and it is commonly used to provide egress to a deck, patio, etc.

Unique problems exist when such sliding doors are utilized in the construction of a home. It is, of course, important to deter water from entering into the interior of the home between the door panels. Additionally, particularly in very cold climates, it is virtually essential to provide structure for deterence of entry of exterior cold into the interior of the home.

The prior art has attempted various solutions to a number of the problems inherent with such doors. One attempted solution has been the placement of a pile dust block at a location under the sliding door panel. The placement of such a component does have the positive effect of inhibiting the entry of dust and other particulate materials into a location behind the sliding door. A significant problem, however, with sliding doors is the the entry of liquids (that is, rain, melted snow and ice, etc.). Such pile dust blocks, because of their nature, enable liquids to seep therethrough, and liquids, once they have passed through a dust block, can rise up over the track on which the slidable door panel moves, to cause damage or, at a minimum, inconvenience within the interior of the home.

It is to these dictates of the prior art and the problems discussed above that the present invention is directed. It is an improved sill construction which functions to better insulate the interior of a home in which a sliding door is installed from adverse external temperature and moisture conditions.

SUMMARY OF THE INVENTION

The present invention is a door sill which comprises a portion of the frame in which a fixed door panel and a sliding door panel are mounted. The fixed door panel is mounted at one end of the frame to occlude a portion of an opening defined within the frame. The sliding door panel is movable upon a longitudinally-extending track, generally parallel to the fixed door panel. The track is defined by the sill. The slidable door panel is provided with a longitudinal dimension sufficient to close a portion of the opening defined within the frame which is unobstructed by the fixed door panel. The track on which the sliding door panel moves is disposed inwardly of the fixed door panel. The sill includes a floor which is external to the opening defined within the frame which is unobstructed by the fixed door panel. Further, the sill includes a platform which is elevated above the sill floor. The platform is disposed intermediate the sliding door panel track and the fixed door panel and extends substantially the length of the fixed door panel.

In the preferred embodiment of the invention, a generally vertically-extending wall, which functions to support the fixed door panel, together with the platform and the generally longitudinally-extending track along which the slidable door panel moves, defines a channel. Typically, the channel would have mounted therein, at an end proximate the location of the slidable door panel when it is in a closed disposition, a pile dust block. Such a dust block functions to inhibit the passage of dust, grit, and other particulate matter into the space between the fixed panel and the track. Moisture and liquids, however, can seep through the dust block into the channel. The generally vertically-extending wall can, in the preferred embodiment, be provided with a plurality of longitudinally-spaced drainage apertures. The sill can be provided with a weep seal in engagement with an outwardly facing surface of the generally vertically-extending wall. Such a seal would, essentially, function as a flapper-like valve that would allow accumulation of moisture within the channel to pass outwardly, but would not allow moisture or liquid to pass inwardly.

The preferred embodiment also includes a weather strip mounted to the track along a length thereof at least as long as the opening defined within the frame which is unobstructed by the fixed door panel. As will be able to be seen then, in view of this disclosure, the weather strip will seal the lower edge of the slidable door panel when it is in a closed disposition.

The weather strip of the preferred embodiment comprises a dual-legged member, a first leg of which is secured in engagement with an outwardly-facing surface of the longitudinally-extending track. The second leg is hinged, substantially along its full length, to the upper edge of the first leg, and means are provided to bias the second leg of the weather strip upwardly and away from the first leg. Such biasing, in effect, urges the second leg into engagement with the lower edge of the slidable door panel.

The present invention is thus an improved sill structure for sliding doors. More specific features and advantages obtained in view of those features will become apparent with reference to the DETAILED DESCRIPTION OF THE INVENTION, the appended claims, and the accompanying drawing figures.

DETAILED DESCRIPTION OF THE INVENTION

Figure 1:
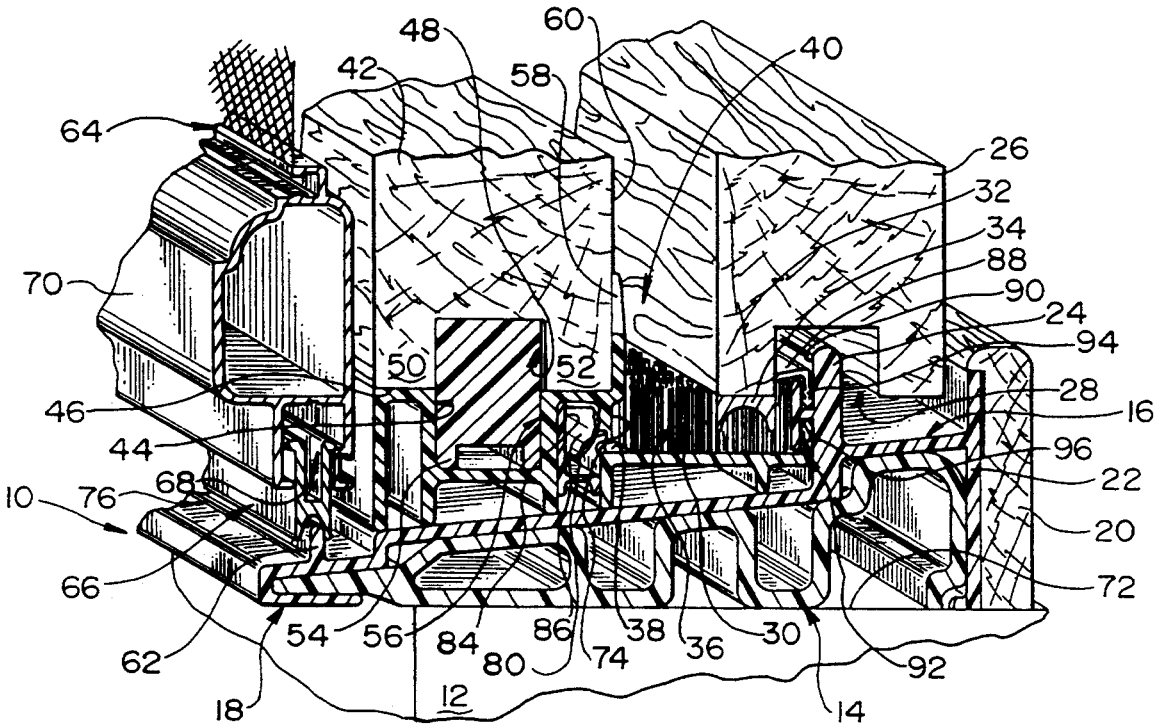
FIG. 1 is a perspective view in section of a door sill in accordance with the present invention, including various door panels mounted thereto.

Referring now to the drawing, wherein like reference numerals denote like elements throughout the several views, FIG. 1 illustrates a sliding door sill construction in accordance with the present invention. The sill 10 is shown as being disposed upon a block 12 which functions as part of the structure, for example, of a home in which the sliding door of which the sill construction is a part is installed. The sill 10 includes a support core 14 and a cladding 16 surrounding the core 14. The core 14 includes a cantilevered portion 18 which extends in an unsupported fashion on the outer side of the building.

FIG. 1 illustrates a baseboard 20 on the inside of the sill 10. The baseboard 20 is shown as being in engagement with a generally vertically-extending panel 22 at the inner end of the sill 10.

The cladding 16 overlying the sill core 14 includes a upwardly extending track 24 which defines a generally vertical plane. A slidable door panel 26 is mounted on the track 24 for lateral reciprocating movement between opened and closed disposition. A rectangular recess 28 is shown being formed in the lower edge 30 of the slidable door panel 26. While this recess 28 is illustrated as having dimensions considerable greater than those of the track 24 on which the panel 26 rides, it will be understood that appropriate hardware fittings (not shown) are mounted within the recess 28 for accommodation of the track element 24.

An outer leg 32 of the bottom edge 30 of the slidable door panel 26 is provided with a fixture 34 at the bottom thereof. The fixture 34 interfaces with a pile dust block 36 carried on the floor 38 of a channel 40 as will be described hereinafter. The pile dust block 36 functions to keep dust, grit, and other particulate materials from entering between the fixed and slidable door panels 42, 26.

FIG. 1 also illustrates a fixed door panel 42 above the sill 10. The fixed panel 42 is mounted on an extrusion 44 seated on the sill 10. It will be understood that the extrusion 44 is, typically, secured to the sill 10 in any appropriate manner such as screws (not shown), etc.

The fixed door panel 42 is shown as having formed in the bottom edge 46 thereof, as is true in the case of the moveable panel 26, a rectangular recess 48. Formation of such a recess 48 defines two legs 50, 52, one on either side of the recess 48. FIG. 1 shows a block 54 received within the recess 48 of the fixed door panel 42, the block 54 also being received in a similarly sized trough 56 formed in the extrusion 44. The block 54 functions to properly align the fixed panel 42 with the extrusion 44. The extrusion 44 also is provided with a flange portion 58 which, when the fixed door panel 42 is in its proper position, engages an inner surface 60 of that door panel 42. The flange 58 further functions to obtain alignment.

The sill 10 in accordance with the present invention also provides a lower track 62 for a screen door panel 64. The panel 64 would, typically, be suspended at its upper end, a lower end being provided with a floating fitting 66 which interfaces with the upwardly extending track 62. As can be seen, the fitting 66 is suspended within an inverted channel 68 extending downwardly from a lower rail 70 of the screen door panel 64. As result, as the screen door 64 is subject to jarring, etc., the fitting 66 can float upwardly.

FIG. 1 illustrates the extrusion 44 defining a platform having an upwardly facing surface 38 generally parallel to an upwardly facing surface 72 of the block 12 on which the sill 10 is seated. This upwardly facing surface 38 of the platform, together with the slidable panel track 24 and a generally vertically-extending wall 74 of the extrusion define channel 40. The floor 38 of this channel 40 (that is, the upwardly facing surface of the platform) is elevated with respect to the upwardly facing surface 76 of the sill 10. This platform (and, in fact, the entire extrusion 44) extends only a portion of the longitudinal length of the sill 10. The upwardly facing surface 76 of the sill 10 defines a floor, and the floor 76 extends the full length of the door closure (that is, from one jamb to the other). The extrusion 44, however, extends only from one jamb to a location along the sill floor 76 substantially at a lateral edge of the fixed door panel 42 which is, typically, proximate the center of the sill. That is, the extrusion 44 is substantially coextensive with the fixed door panel 42. As will be able to be seen then, that portion of the sill floor 76 outwardly from the opening defined within the door frame which is unobstructed by the fixed door panel 42 is at one level. The space between the moveable door panel track 24 and the fixed door panel 42, however, has the floor 38 of the channel 40 defined by the upwardly facing surface of the platform therebetween. This surface 38 is at an elevated level with respect to the rest of the sill floor 76.

It is at the juncture between the sill floor 76 and this raised platform surface 38, and between the slidable door panel track 24 and the fixed door panel 42 that dust, other particulate matter, and liquids will tend to seep into the building in which the door is mounted. Because of the mounting of the pile dust block 36, dust and particulate matter will tend to be excluded. Because of the fact that the platform surface 38 is elevated with respect to the sill floor 76, liquid will be deterred from entering.

Figure 4:
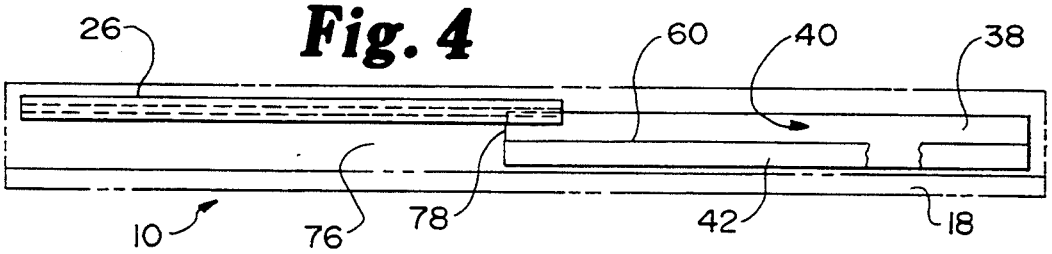
FIG. 4 is a top plan functional diagram of the sill in accordance with the present invention with the slidable door panel in a closed dispostion.
Figure 5:
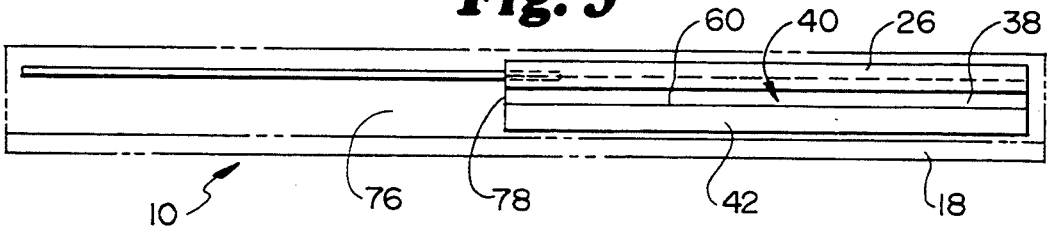
FIG. 5 is a view similar to FIG. 4 with the slidable door panel in an open disposition.

FIGS. 4 and 5 illustrate schematically the slidable and fixed door panels 26, 42 and the elevated platform surface 38. FIG. 4 best illustrates the space through which the undesirable materials will tend to try to enter. That figure shows the break 78 over which liquids would have to migrate in order to enter.

It will be understood that this elevation of the platform surface 38 relative to the sill floor 76 will not exclude all liquid from entering the channel 40 between the slidable door panel track 24 and the fixed door panel 42. For this reason, therefore, the vertically-extending wall 74 which provides, in part, support for the fixed door panel 42 and which defines, together with the upwardly facing surface 38 of the platform and the track 24 along which the slidable door panel 26 moves, the channel 40 can be provided with a plurality of drainage apertures 80 proximate the floor 38 of the channel 40. While only one such aperture 80 is shown in FIG. 1, it will be understood that a plurality would, typically, be spaced longitudinally along the wall 74.

Figure 3:
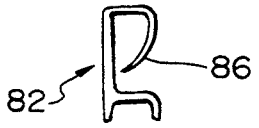
FIG. 3 is a side elevational view of a weep seal able to be employed with the sill.

FIG. 3 illustrates an extruded weep seal member 82 which can be fitted into a trough 84 defined within the extrusion 44. This member 82 is provided with a flap 86 which, when pressure within the trough 84 in the extrusion 44 is greater than that in the channel 40, would come into engagement with the generally vertically-extending wall 74 and close the apertures 80 so that liquids could not seep in a backward direction through the apertures 80. At the same time, however, when pressure in the channel 40 is greater than that in the trough 84, the flap 86 will open to allow drainage of the channel 40. As will be understood in view of this disclosure, the extrusion 82, and particularly the flap portion 86 thereof, will be flexible in nature in order to effect operation as described.

The weep seal member 82 is able to be withdrawn from the trough 84 in which it is intended to be placed. Consequently, should the flap portion 86 of the member 82 deteriorate, the element 82 can be removed and replaced.

Figure 2:
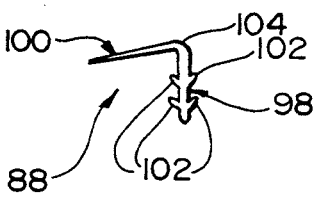
FIG. 2 is a side elevational view of a weather strip seal able to be employed with the sill.

FIG. 2 illustrates a weather strip 88 which can be mounted along an outwardly facing surface 90 of the track 24 along which the slidable door panel 26 moves. The figure illustrates the track 24 as being provided, on its outwardly facing surface 90, with a 90° rotated T-shaped fitting 92. The fitting 92 is shown as being integrally formed with the track 24. The fitting 92, in view of its shape, defines an upwardly opening upper female receptacle 94 and a downwardly opening lower female receptacle 96. FIG. 2 illustrates a weather seal which comprises two legs 98, 100. A first leg 98 is shown as having a pair of barbs 102 formed thereon. The barbs 102 angle outwardly and in a direction away from the distal end of the first leg 98. Consequently, should the first leg 98 of the weather strip 88 be inserted into the upper female receptacle 94, the barbs 102 will function to inhibit withdrawal of the weather strip 88 from the receptacle 94.

When the weather strip 88 is so received within the upper female receptacle 94, the first leg 98 of the strip 88 is disposed to engage the outwardly facing surface 90 of the track 24 along which the slidable panel 26 moves. The upper end of the first leg 98 has, hinged thereto, as at 104, a second leg 100. The second leg 100 is disposed for pivoting about an intersection about the two legs 98, 100. The second leg 100 is biased upwardly and outwardly from the first leg 98. Typically, this bias would be occasioned in view of the nature of the material of which the weather strip 88 is formed and the manner in which it is molded.

Referring to FIG. 5, it will be seen that the weather strip 88 is mounted so that it extends substantially along the full portion of the opening which is unobstructed by the fixed door panel 42 and, additionally, a small distance behind the fixed door panel 42. Such a disposition will ensure that at least a portion of the weather strip 88 is always in engagement with the lower edge of the moveable door panel 26. As best seen in FIG. 1, the biasing of the second leg 100 of the weather strip 88 will, in effect, accomplish such engagement when the moveable door panel 26 is closed. Therefore, a positive seal along the length of the moveable door 26 will be provided.

It will also be seen that the lower female receptacle 96 extends fully, substantially, across the opening which the door panels 26, 42 are intended to close. This is so, since the track 24 extends substantially fully across that opening. The lower female receptacle 96 of the T-shaped fitting 92, therefore, can serve as a dike to inhibit migration of liquids over the track 24 and into the interior of the building into which the door is installed.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. A door sill for receipt in a frame mounting a fixed door panel at one end thereof and a sliding door panel movable along a longitudinally-extending track, defined by said sill, generally parallel to the fixed door panel and able to close a portion of an opening defined within the frame which is unobstructed by the fixed door panel, wherein the sliding door panel is disposed inwardly of the fixed door panel for movement, comprising:

(a) a sill floor external to the portion of the opening, defined within the frame, which is unobstructed by the fixed door panel;

(b) a platform, elevated above said sill floor, intermediate the sliding door panel track and the fixed door panel, extending substantially the length of the fixed door panel and abutting, at an inner end thereof, the sliding door panel track to define, in part, a drainage channel;

(c) a weather strip, having a pair of discrete legs, extending along an outer surface of the longitudinally-extending track along which the sliding door panel moves at least the length of the opening defined within the frame which is unobstructed by the fixed door panel, a first leg of said weather strip being generally planar, and generally parallel to, and engaged against the longitudinally-extending track along which the sliding door panel is movable, and a second generally planar leg of said weather strip being hinged, at a top edge thereof, to a top edge of said first leg; and (d) means for biasing said second leg upwardly and away from said first leg and into engagement with a bottom edge of the sliding door panel.

2. The door sill of claim 1 further comprising a generally vertically-extending wall intersecting said platform and spaced outwardly from the longitudinally-extending track along which the sliding door panel moves, said generally vertically-extending wall functioning as a support for the fixed door panel, said generally vertically-extending wall, said platform, and the longitudinally-extending track along which the sliding door panel moves, together, defining said channel, elevated above said sill floor.

3. The door sill of claim 2 wherein said generally vertically-extending wall has a plurality of longitudinally-spaced drain apertures formed therein, and further including weep seal means, disposed against an outer surface of said generally vertically-extending wall to facilitate drainage of moisture accumulating in said channel.

4. The door sill of claim 1 further including a dike carried by the longitudinally-extending track along which the sliding door panel moves, at a location below said weather strip.

* * * * *